US006192295B1

(12) United States Patent
Gunther

(10) Patent No.: US 6,192,295 B1
(45) Date of Patent: Feb. 20, 2001

(54) METHOD OF SORTING PRINTED DOCUMENTS AND FEEDING THEM TO A FINISHING MACHINE

(76) Inventor: William H. Gunther, P.O. Box 586, Mystic, CT (US) 06355

( * ) Notice: Under 35 U.S.C. 154(b), the term of this patent shall be extended for 0 days.

(21) Appl. No.: 09/188,406

(22) Filed: Nov. 10, 1998

Related U.S. Application Data

(60) Provisional application No. 60/065,018, filed on Nov. 10, 1997.

(51) Int. Cl.[7] ..... G06F 7/00

(52) U.S. Cl. ..... 700/225; 270/52.02; 700/215

(58) Field of Search ..... 700/215, 221, 700/225, 226, 227; 270/52.02, 52.14; 271/225, 145, 171, 3.01, 3.13; 206/459.5

(56) References Cited

U.S. PATENT DOCUMENTS

| | | | | |
|---|---|---|---|---|
| 4,626,672 | * | 12/1986 | Sapitowicz et al. | 271/225 X |
| 4,949,948 | * | 8/1990 | Petersen | 270/52.14 |
| 5,013,022 | * | 5/1991 | Graushar | 270/52.02 X |
| 5,050,106 | * | 9/1991 | Yamamoto et al. | 700/225 |
| 5,174,454 | * | 12/1992 | Parkander | 700/221 X |
| 5,207,412 | * | 5/1993 | Coons, Jr. et al. | 270/52.02 X |
| 5,228,678 | * | 7/1993 | Matsuda et al. | 271/145 |
| 5,317,654 | * | 5/1994 | Perry et al. | 270/52.02 X |
| 5,439,209 | | 8/1995 | Runzi . | |
| 5,445,271 | * | 8/1995 | Kakizaki et al. | 206/459.5 |
| 5,651,798 | * | 7/1997 | Conboy et al. | 29/25.01 |
| 5,809,360 | * | 9/1998 | Blake et al. | 271/171 X |
| 5,816,773 | * | 10/1998 | Fehringer et al. | 270/58.14 X |
| 5,992,324 | * | 11/1999 | Rombult et al. | 271/145 X |
| 6,070,731 | * | 6/2000 | Kobayashi et al. | 414/940 X |

FOREIGN PATENT DOCUMENTS

| | | |
|---|---|---|
| 0386787 | 9/1990 | (EP) . |
| 0914969 | 5/1999 | (EP) . |
| WO96/40575 | 12/1996 | (WO) . |

OTHER PUBLICATIONS

Nester, "ProblemLosungen bei der Drunk–verarbeitung von Kleinstauflagen", *Deutscher Drunker*, vol. 33, No. 44 pp. W6, W8, W10, W12, W14, (1997).

IBM Technical Disclosure Bulletin, "Method for Stacking Books According to Sort Levels", vol. 36, No. 9B pp. 213–215, (1993).

* cited by examiner

*Primary Examiner*—Christopher P. Ellis
*Assistant Examiner*—Patrick Mackey
(74) *Attorney, Agent, or Firm*—Browdy and Neimark

(57) ABSTRACT

The sheets which are outputted from a printing device are stacked in an exchangeable cassette mounted on an input unit in successive order as they are printed. An identifying label on the cassette is read by a reader and stored in a central controller. An address of each document, and preferably of each page of each document, is stored in the controller in successive order and associated with the label signal as the documents are stacked. An output unit for picking up the individual documents is associated with a finishing machine. A full cassette is introduced into the output unit. A second reader on the output unit reads the label on the cassette that has been placed into the output unit. The second sensor is connected to the controller. The finishing machine is controlled by the controller in response to the label signal and the address signals of the documents.

18 Claims, 1 Drawing Sheet envelop stuffer
binder
printer
OFFSET
SYSTEM CONTROLLER
4 STATION INSERTER/ ENVELOPE STUFFER-SEALER/CONVEYOR
POLICY BIND/ LTR-GIRO-POLICY COLLATOR UNIT
HCIO CASSETTE 180° ROTATION
LOAD CASSETTE
BARCODE READER
OFFSET SHEET FEEDER
HIGH SPEED LASER PRINTER
CASSETTE STORAGE
BATCH TRANSPORT
HCIO CASSETTE (UNLOAD)

METHOD OF SORTING PRINTED DOCUMENTS AND FEEDING THEM TO A FINISHING MACHINE

This application claims the benefit of U.S. provisional application No. 60/065,018, filed Nov. 10, 1997.

FIELD OF THE INVENTION

The present invention relates to a method of sorting printed documents consisting of one or a plurality of paper sheets in a stacker and feeding the documents to a finishing machine, e.g. a folding and enveloping machine or a binder.

BACKGROUND OF THE INVENTION

In modern high speed printing machines, e.g. laser printers, the individual papers of the successive documents or jobs are printed in successive order of their page number and outputted with their printed side down. The printed papers are stacked in a stacker. The sheets of the individual documents are then in correct order. If the sheets are printed in Duplex mode, the odd page numbers usually face down. The printing may also be done in the reverse order of the sheet numbers and the stacking performed with the printed side or the odd page numbers up.

In U.S. Pat. No. 5,439,209 to Kurt Rünzi a stacker is disclosed which is capable of separating the individual jobs on the stack. The papers are fed to a conveyor belt which transports them to the stack in a cassette. A lateral guide rail for the papers can be swiveled between two positions. The switching position of the guide rail is changed each time a document or job is finished, i.e. after the last page of that job has passed the conveyor belt.

SUMMARY OF THE INVENTION

The problem to be solved with the present invention is to improve the handling of such a stacker and to enable an efficient further processing of the stacked documents in a finishing machine.

This problem is solved by the present invention which comprises a method of sorting printed documents consisting of at least one sheet of paper and feeding them to a finishing machine. The sheets which are outputted from a printing device are stacked in an exchangeable cassette mounted on an input unit in successive order as they are printed. An identifying label on the cassette is read by a reader and stored in a central controller. An address of each document, and preferably of each page of each document, is stored in the controller in successive order and associated with the label signal as the documents are stacked. An output unit for picking up the individual documents is associated with a finishing machine. A full cassette is introduced into the output unit. A second reader on the output unit reads the label on the cassette that has been placed into the output unit. The second reader is connected to the controller. The finishing machine is controlled by the controller in response to the label signal and the address signals of the documents.

BRIEF DESCRIPTION OF THE DRAWINGS

A preferred embodiment of the present invention is described hereinafter with reference to the enclosed drawing, in which.

DETAILED DESCRIPTION OF A PREFERRED EMBODIMENT

Figures 1, 2:
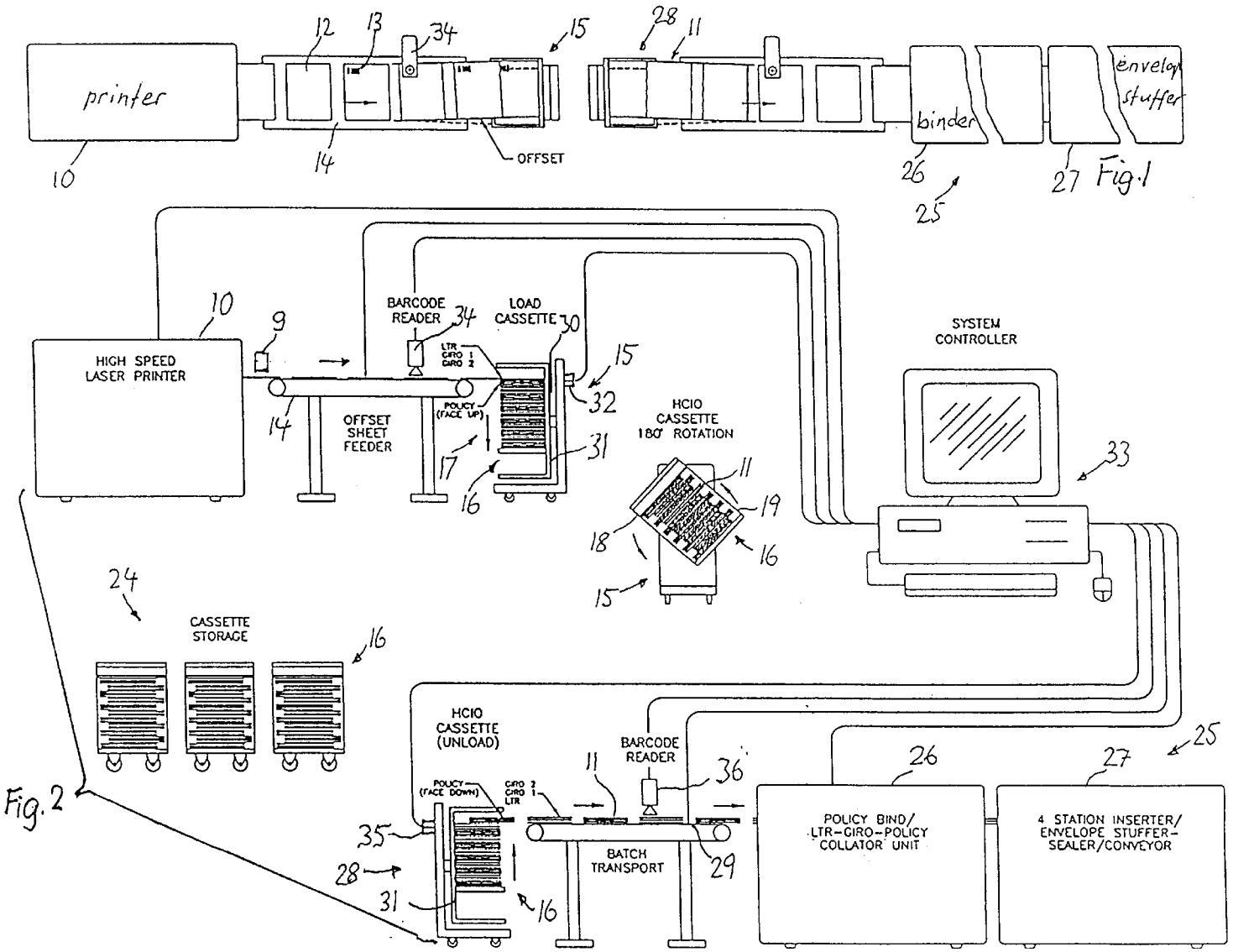
FIG. 1 is a schematic top view of a stacking and sorting apparatus.
FIG. 2 is a diagram of the system for controlling the stacking and sorting apparatus.

In FIG. 1 an input unit and an output unit are shown schematically. A high speed printer 10 prints documents 11 as a successive order of sheets 12. An additional print head 9 may be arranged over the input end of the conveyor 14, e.g. an ink jet print head, which prints on each sheet 12 or only on the front page of each document 11 an optically readable code such as a bar code 13, e.g. with ink, which is only visible in the infrared range of light. The output of the printer 10 is connected to a belt conveyor 14. The conveyor 14 has guide rails which are spaced further apart than the width of sheets 12. The belt can be pivoted between two positions such that the sheets 12 are guided either along the left or along the right guide rail. The switching position is changed each time the last sheet 12 of a document has passed the conveyor 14. This type of job separation, although with a different switching mechanism, is disclosed in Kurt Rünzi's U.S. Pat. No. 5,439,209 (see guide rail 54) which is incorporated herein by reference. The sheets 12 are stacked in a cassette 16 which is mounted on an input unit 15 and which is lowered as the stack 17 builds up. That input unit 15 is disclosed in Kurt Rünzi's copending U.S. patent application Ser. No. 60/065,017 entitled "An apparatus for stacking and sorting printed documents and feeding them to a finishing machine", filed on Nov. 10, 1997 and its related U.S. and EP patent applications, which are incorporated herein by reference. Each even number of document 11 is stacked in the cassette 16 adjacent its left side wall 18 and each odd number of document 11 adjacent the right side wall 19 or vice versa. When a stack 17 is completed, it is compressed and then turned around by 180° about a horizontal axis such that the first printed document is now on top of the stack 17 in the cassette 16.

The cassette 16 is then lowered to the bottom positions and then removed from the input unit 15 onto a trolley and moved either to a cassette storage 24 or directly to a finishing machine 25. The finishing machine 25 may e.g. comprise a binder 26 and an inserter/envelope stuffer/sealer or may be a variety of different finishing devices. The cassette is placed in an output unit 28 which is similar in construction to the input unit 15 except that it does not have a means to compress the stack in the cassette 16 and that it may not be necessary to turn the cassette around by 180° and that it has separating means for picking up the topmost document. This output unit 28 is also disclosed in the above mentioned U.S. patent application to Kurt Rünzi incorporated by reference. The output unit 28 picks up the documents 11 one by one and pushes them onto a conveyor belt 29 which transports them to the finishing machine 25.

Each cassette 16 has an identifying label 30, e.g. on one of its walls 18, 19 or 31, e.g. an electronic button or a bar code. Before the stack forming is started in the input unit 15, this label 30 is read by a sensor 32 on the input unit 16 which interprets the signal sensed into a numeric code. This signal is transmitted to a central controller 33. As the sheets 12 pass the conveyor 14, a further sensor 34 reads the bar codes 13. The sensor 34 may be supplemented or substituted by an optical character recognition system (OCR). Any other optical recognition technology may be utilized. The sensor 34 is also connected with the controller 33. The printing and reading of the readable codes 13, however, is not mandatory. This information may also be obtained directly from the printer 10 or the computer controlling the printer. An instance for this could be a run of 200 books of 20 pages each. In this case, the information would be keyed into the controller and the controller would then just count 20 sheets and then offset the next set of 20 pages for the next book in the input device. Another possibility is that the readable codes 13 are printed directly in the printer 10 and the printer 10 transmits a signal corresponding to the signal of the reader 34 to the controller 33. The bar code 13 may contain information how the document concerned is to be handled in the finishing machine 25. In any event by sensing the label 30 and storing this signal together with the information about the documents (or each sheet of the documents) in a register in the controller 33 it is assured that the controller 33 knows where each document 11 is located in which cassette 16.

At the finishing machine 25 a further sensor 35 on the output unit 28 again reads the label 30 of the inserted cassette 16. The documents are picked up one by one in the output unit by L-shaped fingers pivotable about a horizontal axle and arranged on both sides in the marginal space between a topmost document 11, whose side edge is spaced from the respective side wall of the cassette, and said side wall. The axles are pivoted by separate motors. This type of sorting is disclosed in Kurt Rünzi's co-pending U.S. patent applications mentioned above (see axles 81, fingers 85 and motors 83). The fingers lift the topmost document and a pusher (89 in Rünzi) pushes that document between two pairs of transport rolls (91 in Rünzi) which transports it onto the conveyor 29. The height of the cassette 16 in the output unit 28 is controlled by the signal of two sensors (72 in R ünzi) such that the fingers of the actuated axle slightly press on the second document and grip between that one and the lowest sheet of the topmost document for lifting this one. A sensor 36 reads the bar code 13 on the first page of each document 11. The sensors 35, 36 are also connected to the controller 33 which, in addition, controls the operation of the finishing machine 25. The sensor 36 increases the security of the system because with the signal of the sensor 36 the controller 33 can verify the information it already has from the content of the register associated with the sensed identifying label 30.

The controller 33 in addition controls the printer 10 at least for starting and stopping it. The printer 10 is started after a new, empty cassette 16 has been inserted in the output unit 15 and the identifying label 30 has been read. The cassette 16 is lowered as the stack 17 builds up such that the top sheet 12 on the stack 17 is always slightly below the transporting plane of the belt 14. Each sheet 12 fed to the stacker 15 is recorded in the controller 33 on its hard disc and associated with the signal from the sensor 32. When a predetermined number of sheets, e.g. 6000, has been stacked, the controller 33 stops the printer 10 after the last page of the particular document 11 then being printed, is emitted from the printer 10.

Since the controller 33 can identify each cassette and has stored the information about each document 11 in the stack 17 and its position within the stack 17 and how each document is to be handled in the finishing machine, this record can be used to control the finishing machine fully automatically. This record is also very useful when a series of documents should be treated in the finishing machine at a specific time of the day, e.g. to meet a time limit for mailing. By feeding the whole documents one by one to the finishing machine a considerably lower handling rate is required since the documents usually consist of a number of pages, e.g. on average 20 pages.

The same system can also be used in connection with printers which output the sheets with the printed side up. In that case the last sheet of each document is printed first. It may not be necessary to turn the cassette around by 180° if in the central controller the register of documents associated with each of the label signals is accessible from both ends. In this case, however, the storage of the documents would not be first-in-first-out as it is often desired. The belts 14 and/or 29 may be transparent. In this case, the address bar code 13 may be printed on the sheets 12 either on the front or the rear side.

If it is printed on the rear side, the code 13 on the last sheet of each document should have the information on how to handle the document 11 in the finishing machine, if it is desired to verify this information with the sensor 36, this one should be placed on the proper side of the belt 29.

A deflector (not shown) may be arranged between the printer 10 and the conveyor 14 that in normal operation transmits the sheets 12 directly from the printer 10 to the conveyor. In case of a paper jam or the like on the conveyor 14 or the input unit 15, the controller 33 immediately sends a stop signal to the printer 10 and switches the deflector to its other position in which it deflects the remaining sheets still outputted from the printer 10 after it has received the stop signal (up to eight pages which are already in the print cycle) into a trash bin.

An additional conveyor may be arranged between the printing device 10 and the conveyor 14.

What I claim is:

1. A method for sorting printed documents consisting of at least one sheet of paper and feeding the documents to a finishing machine, comprising stacking the documents, which are outputted from a printing device, in an exchangeable cassette which is mounted in an input unit, in successive order as they are printed, reading an identifying label on the cassette by a first reader to produce a label identifier sensor signal and storing the sensor signal in a central controller, storing a document address of each document in a register of the controller in successive order and in association with the label identifier sensor signal as the documents are stacked in the cassette, introducing said cassette into an output unit for picking up the individual documents and associated with the finishing machine, reading said label with a second reader on the output unit and connected to the controller in the output unit, and wherein the finishing machine is controlled by the controller in response to the signal sensed by the second reader and the document addresses of the documents associated to the sensed label signaling the register.

2. The method of claim 1, wherein each sheet of each document is associated with an individual sheet address.

3. The method of claim 1, wherein the document addresses are printed on a first or last sheet of each document as a code.

4. The method of claim 3, wherein the code is printed with invisible ink.

5. The method of claim 3, wherein the code is read by a third reader as the sheets are fed to the input unit, the third reader being connected to the controller.

6. The method of claim 5, wherein a fourth reader is associated with the output unit, the fourth reader reading the code as the documents are transferred from the output unit to the finishing machine, the fourth reader being connected to the controller.

7. The method of claim 1, wherein, as a stack is finished in the cassette of the input unit, the stack is compressed and then turned by 180° about a horizontal axis.

8. The method of claim 1, wherein the document addresses are provided with information on how each document of the stack in the cassette is to be treated in the finishing machine.

9. The method of claim 1, wherein after a stack has been formed in the cassette in the input unit the cassette is first moved to a storage space for several cassettes, from where a selected cassette is moved to the finishing machine.

10. The method of claim 1, wherein a deflector is arranged immediately downstream of the printing device and wherein, upon detection of a malfunction in the input device or in a transfer of the sheets to the input device, the controller sends a stop signal to the printing device and switches the deflector.

11. A method of sorting printed documents consisting of at least one sheet of paper and feeding the documents to a finishing machine (25), stacking the documents in successive order as said documents are outputted from a printing device (10) into an exchangeable cassette (16) which is mounted on an input unit (15), reading an identifying label on the cassette (30) by a first reader to produce a label identifier sensor signal and storing the sensor signal in a central controller (33), storing a document address by reading each document with a second reader (34) in a register of the central controller in successive order and in association with the label identifier sensor signal as the documents are stacked in the cassette, introducing said cassette into an output unit (28) for picking up the individual documents, wherein said output unit is associated with the finishing machine (25), reading said identifying label with a third reader (35) on the output unit to generate a third reader signal, and sending said third reader signal to the central controller (33), reading the document address with a fourth reader (36) to verify the information in the central controller (33), wherein the finishing machine is controlled by the central controller (33) in response to the signal received by the second reader and the document address of the documents associated to the sensed label signaling said register of said central controller.

12. The method of claim 11, wherein each sheet of each document is associated with an individual sheet address.

13. The method of claim 11, wherein the document addresses are printed on a first or last sheet of each document as a code.

14. The method of claim 13, wherein the code is printed with invisible ink.

15. The method of claim 11, wherein, as a stack is finished in the cassette of the input unit, the stack is compressed and then turned by 180° about a horizontal axis.

16. The method of claim 11, wherein the document addresses are provided with information on how each document of the stack in the cassette is to be treated in the finishing machine.

17. The method of claim 11, wherein after a stack has been formed in the cassette in the input unit, the cassette is first moved to a storage space for several cassettes, from where a selected cassette is moved to the finishing machine.

18. The method of claim 11, wherein a deflector is arranged immediately downstream of the printing device and wherein, upon detection of a malfunction in the input unit or in a transfer of the sheets to the input unit, the controller sends a stop signal to the printing device and switches the deflector.

* * * * *